US007537180B2

(12) United States Patent
Morand

(10) Patent No.: US 7,537,180 B2
(45) Date of Patent: May 26, 2009

(54) PAPER ROLL AND PAPER ROLL DISPENSER

(75) Inventor: Michel Morand, Ile-des-Soeurs (CA)

(73) Assignee: Cascades Canada Inc., Montreal, Quebec (CA)

( * ) Notice: Subject to any disclaimer, the term of this patent is extended or adjusted under 35 U.S.C. 154(b) by 366 days.

(21) Appl. No.: 11/414,975

(22) Filed: May 1, 2006

(65) Prior Publication Data

US 2007/0075180 A1 Apr. 5, 2007

Related U.S. Application Data

(60) Provisional application No. 60/722,411, filed on Oct. 3, 2005.

(51) Int. Cl.
*B65H 49/18* (2006.01)

(52) U.S. Cl. ..... 242/596.7; 242/608; 242/610.6; 242/614

(58) Field of Classification Search ..... 242/588, 242/588.3, 588.6, 596.7, 608, 608.2, 608.6, 242/608.7, 609, 609.1, 610.6, 613, 614
See application file for complete search history.

(56) References Cited

U.S. PATENT DOCUMENTS 2,269,939 A * 1/1942 Janisch ..... 242/613.5
2,928,619 A * 3/1960 Burton et al. ..... 242/596.7
3,083,928 A * 4/1963 Voissem ..... 242/613.5
3,627,220 A * 12/1971 Vogel ..... 242/613.5
3,840,194 A * 10/1974 Vetter ..... 242/613.5
RE30,168 E * 12/1979 Mason ..... 242/613.5
4,659,031 A * 4/1987 Saraisky ..... 242/613.5
5,322,234 A * 6/1994 Robert et al. ..... 242/596.7
6,390,428 B1 * 5/2002 Oshima ..... 248/266
7,191,979 B2 * 3/2007 Paukov ..... 242/613.5

* cited by examiner

*Primary Examiner*—William A Rivera
(74) *Attorney, Agent, or Firm*—Merchant & Gould, P.C.

(57) ABSTRACT

The invention provides a paper roll, a bushing for a paper roll and a combination of a paper roll with a dispenser. The paper roll comprises a hollow paper roll core with two opposite extremities. The bushing has a cylindrical body press-fitted into at least one of the extremities of the paper roll core and the bushing further comprises a circular end wall frangibly fixed to a first end of the body and closing the extremity of the paper roll core. The end wall is provided with a central pin-receiving hole. The end wall is designed to breaks off when removing the paper roll from the dispenser. Thus, the bushing cannot be reused. Therefore, this invention participates in the enhancement of a quality control system.

20 Claims, 9 Drawing Sheets

PAPER ROLL AND PAPER ROLL DISPENSER

FIELD OF THE INVENTION

The present invention generally relates to paper roll and paper roll dispensers, for example for paper towels or toilet paper.

BACKGROUND OF THE INVENTION

Several types of paper roll dispensers exist in the prior art. These systems are used to gradually provide to a user of the dispenser different types of paper rolled around an inner core, hereinafter referred to as a "paper roll". The most common of these dispensers dispenses paper items such as paper towels and toilet paper. These dispensers are often used in public area washrooms.

An example of such a dispenser is disclosed in U.S. Pat. No. 3,029,035 (LAYTON). This document describes a dispenser for use with rolls having a circular conical recess in the paper surrounding the roll. Bearings on the dispenser are used to support the roll and are shaped to be compatible with the conical recess, thus allowing rotation of the roll within the dispenser. There is also U.S. Pat. No. 4,013,236 (PERRIN), which discloses a dispenser compatible with a different type of roll. The paper roll comprises axially extending and diametrically opposed pin holes, radially spaced from the roll central axis and outside of any core. The dispenser comprises end holder engagement means to hold the roll in the dispenser until the roll has been unwounded to the extremities of the pin holes. U.S. Pat. No. 4,431,141 (SCHUTZ) discloses a method of making an automatically dismountable roll paper product. During winding, the core and the paper are relatively displaced axially to provide a groove at one end of the roll product and a boss at the other. There is also U.S. Pat. No. 4,974,783 (CAMPBELL), which discloses a paper towel dispenser for use with a roll having a groove at at least one end thereof. The dispenser includes support members supporting the ends of the roll and a projection extending from at least one of the support members. The projection is positionable in the groove and frictionally engages the roll to stabilize the roll and resist rotation thereof.

Other examples of known paper roll dispensers are provided with fitting pieces such as bushings to prevent misplacement or withdrawal. The bushings are intermediary pieces permanently or removably placed in an extremity of the core of the paper rolls. It is the case of U.S. Pat. No. 2,390,644 (GRONDONA), which discloses a system comprising a paper roll, a bushing and a dispenser having two supporting members for supporting the paper roll. At one extremity of the paper roll, there is provided a system for receiving the bushing. One of the objects of GRONDONA's invention is to provide a dispenser that prevents misplacement of the paper roll inside the dispenser and a paper roll without a bushing secured to the paper roll core. It is also the case of U.S. Pat. No. 2,928,619 (BURTON et al.), which discloses a supply roll of sheet material having a paper board core and a coupling device secured in the core. The coupling device is designed to prevent the paper roll from withdrawing once inserted into the core.

Several other documents generally describe paper dispensers and these documents are known to the Applicant by the following: U.S. Pat. Nos. 1,999,765; 3,079,099; 3,301,499; 3,438,589; 3,704,837; and 4,431,141.

Further types of known paper roll dispensers intend to discriminate the paper rolls, for example to better control the quality and reduce maintenance fees. That is the case of US application 2005/0011987 A1 (LEMAIRE et al.) by the same Applicant, which discloses a dispenser with an electrical system for recognizing the paper rolls. There is U.S. Pat. No. 6,749,149 B1 (FRIESEN), which discloses a system preventing a dispenser from receiving paper rolls that were not specifically tailored for the dispenser. There is also U.S. Pat. No. 5,597,135 (VANDERSTEENE), which discloses a fitting piece for the paper roll core. The purpose of such a fitting piece is to guaranty a sales right for replacement of the rolls.

On reading these last examples of prior art paper roll dispensers, one can appreciate that it could be advantageous for several different reasons, notably for reasons of quality control and a reduction of maintenance and repair costs for dispensers, to develop paper roll dispensers which can only operate with paper rolls specifically tailored for use in the dispensers, and paper rolls which can only operate with specifically tailored dispensers.

Although, a number of prior art apparatuses have been developed in the recent years for that specific purpose, there is still a need for an improved type of paper roll product and dispenser compatible with such a roll product, which can reduce the occurrences of damages caused to the dispenser through installation of an incompatible roll product in the dispenser.

SUMMARY OF THE INVENTION

It is an object of the present invention to provide a paper roll, a bushing for a paper roll and a combination of a paper roll with a dispenser which satisfy the above-mentioned need.

According to the present invention, that object is achieved with a paper roll comprising a hollow paper roll core with two opposite extremities. A bushing having a cylindrical body is press-fitted into at least one of the extremities of the paper roll core. The bushing further comprises a circular end wall frangibly fixed to a first end of the body and closing the extremity of the paper roll core. The end wall is provided with a central pin-receiving hole.

By "frangibly fixed", it is meant that the link between the end wall and the body of the bushing is capable of being easily broken; it is breakable.

The present invention also concerns a combination of a paper roll dispenser with a paper roll as described above, the dispenser comprising support members for supporting the extremities of the paper roll core, and a projection protruding from at least one of the support members, the projection comprising a support flange for engaging the pin-receiving hole of the bushing and maintaining the paper roll generally in alignment between the support members.

Because of the presence of the bushing, which comprises an end wall provided with a pin-receiving hole, a paper roll according to the invention cannot fit any paper roll dispenser. It has to be mounted in a paper dispenser tailored to receive a paper roll according to the invention. More specifically, the paper dispenser has to be as just defined above.

Moreover, if one tries to dismount the paper roll to replace it by a new roll of paper, the chances that the frangible end wall break off are considerable, and the paper roll core cannot be used a second time.

Consequently, the paper roll dispenser cannot be used to dispense paper from rolls which either do not have a bushing as described above inserted into one end of the paper roll core, or rolls that have a bushing from which the frangible end wall has been broken. This constraint ensures that only paper rolls having the integral bushing with the end wall intact can be used with the above-described dispenser. This system thus results in a form of quality control as there is a reduction of maintenance and repair costs for the dispensers. Occurrences of damages caused to the dispenser through installation of an incompatible roll product in the dispenser are reduced since the dispenser can only function properly when a compatible paper roll having an appropriate bushing is used in the system. The dispenser manufacturer can then ensure that only certain types of paper rolls having the appropriate bushing are installed in their machines.

BRIEF DESCRIPTION OF THE DRAWINGS

The present invention and its advantages will be more easily understood after reading the following non-restrictive description of preferred embodiments thereof, made with reference to the following drawings in which.

DESCRIPTION OF PREFERRED EMBODIMENTS OF THE INVENTION

Figure 1:
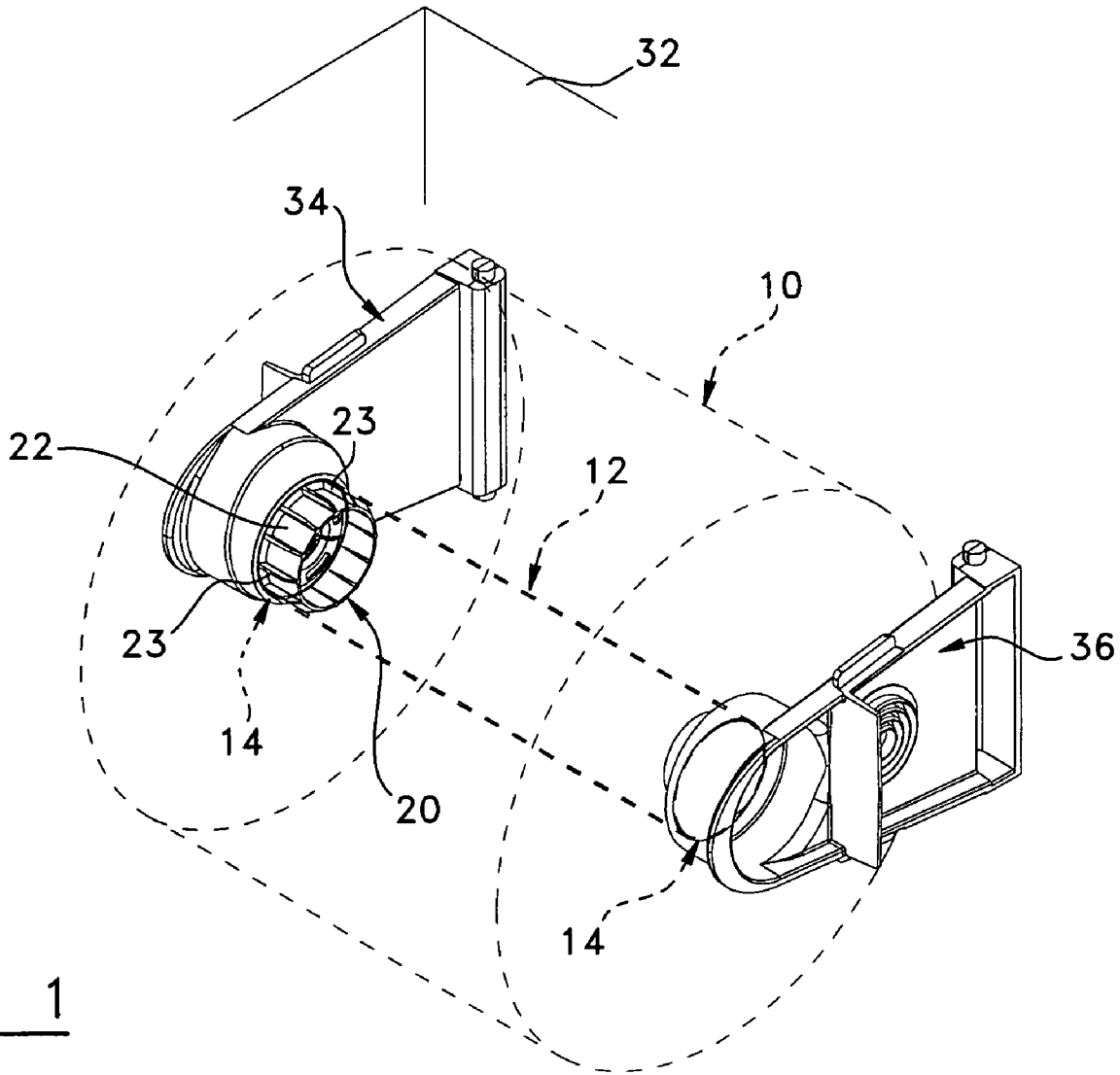
FIG. 1 is a perspective view of a paper roll according to a preferred embodiment of the invention, mounted between the support members of a compatible dispenser.
Figure 2:
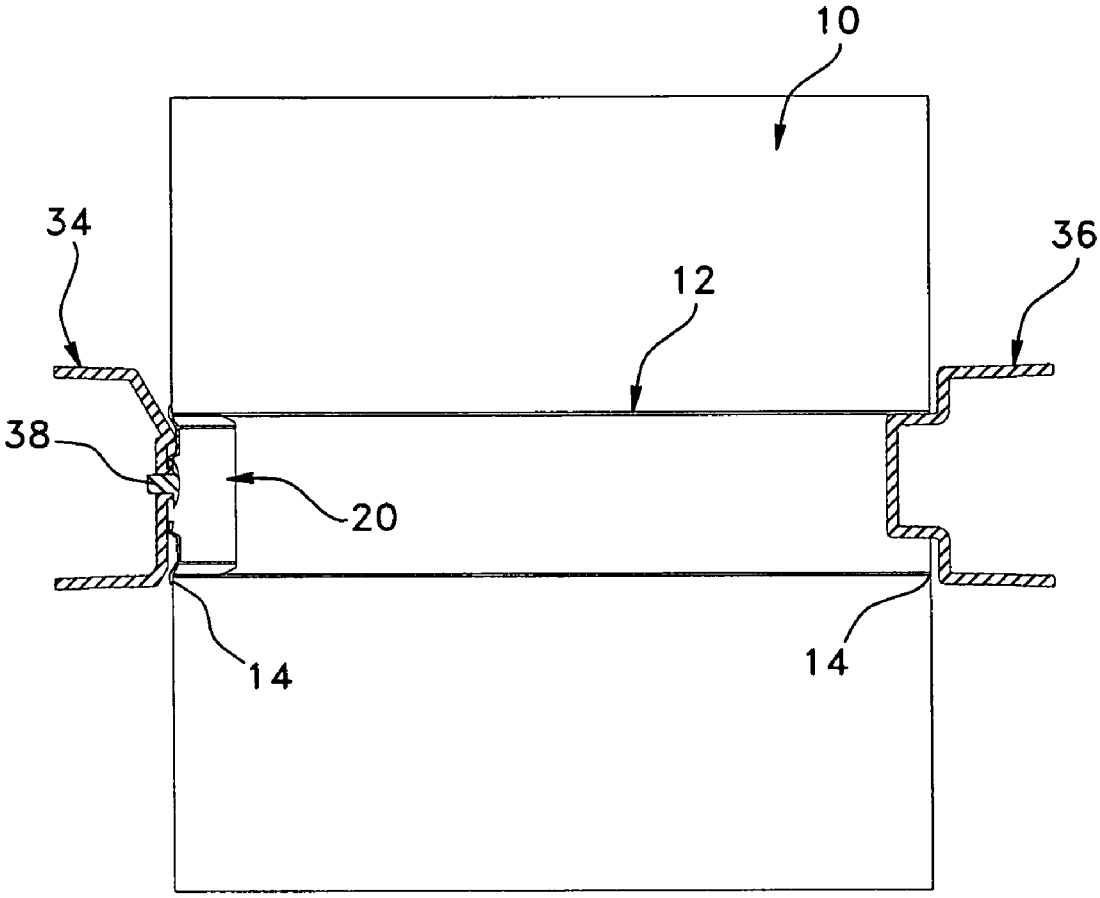
FIG. 2 is a cross-sectional side view of what is shown in FIG. 1.

In the following description, similar features in the drawings have been given similar reference numerals and in order to not unduly weigh down the figures, some elements are not referred to in some figures if they were already identified in a precedent figure.

Referring to FIG. 1, a paper roll 10 according to a first preferred embodiment is illustrated, mounted between the support members 34, 36 of a compatible dispenser 32. For clarity purposes, only the support members 34, 36 of the dispenser are illustrated. The remaining elements of the dispenser are very common and well known for a person skilled in the art. As such, they do not need further description.

Figure 3:
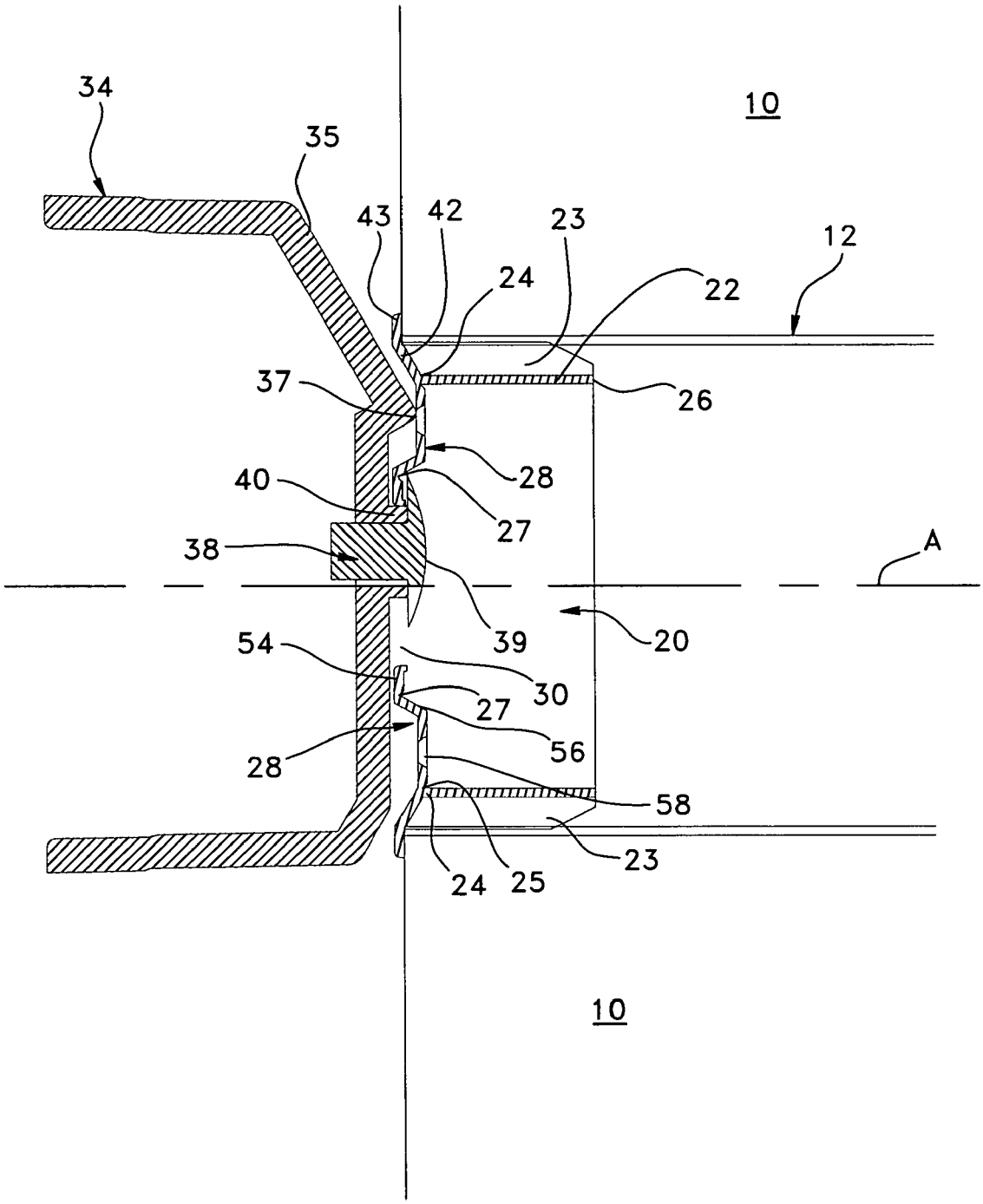
FIG. 3 is an enlarged view of a portion of the bushing and the dispenser supporting members shown in FIG. 1.
Figure 4B:
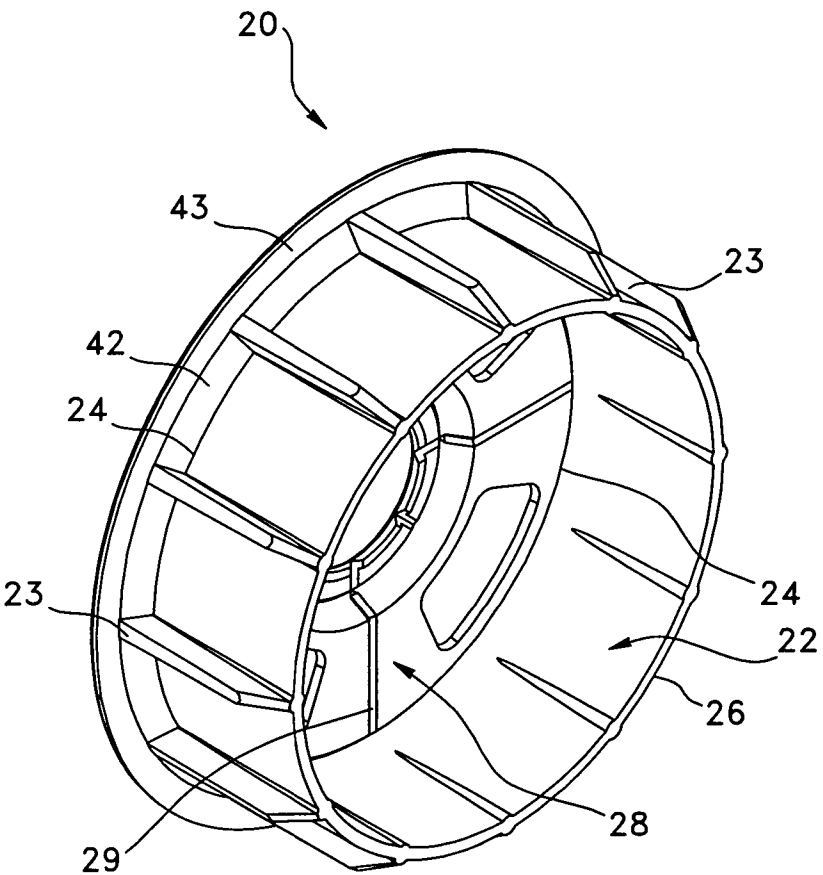
FIG. 4*a* is a perspective view of the bushing shown in FIG. 1 viewed from the front end and FIG. 4*b* is a perspective view of the bushing viewed from the rear end.
Figure 4A:
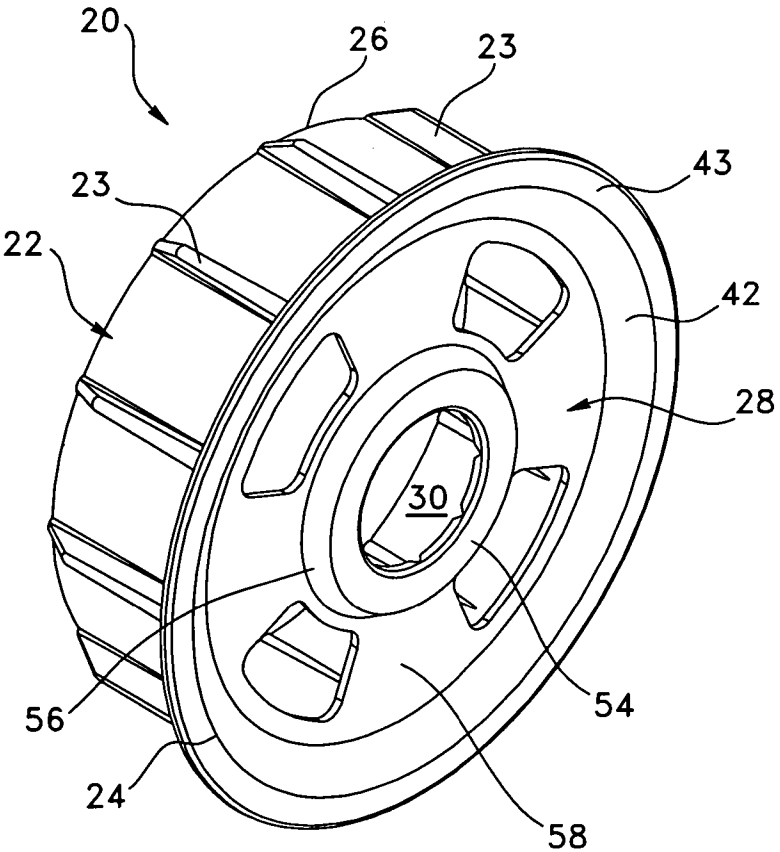

Turning now also to FIGS. 2, 3, 4*a* and 4*b*, the paper roll 10 comprises a paper roll core 12 with two opposite extremities 14 and a bushing 20 having a cylindrical body 22 press-fitted into one of the extremities 14 of the paper roll core 12. The body 22, as best shown in FIGS. 4*a* and 4*b*, has a first end 24 opposite a second end 26 and the bushing 20 further comprises a circular end wall 28 frangibly fixed to the first end 24 of the body 22 and closing the extremity 14 of the paper roll core 12. The end wall 28 is provided with a central pin-receiving hole 30. It is worth mentioning that a bushing according to the invention can be press-fitted in either one or in both extremities 14 of the paper core 12 without departing from the scope of the present invention. For a purpose of clarity, the following description will focus only on the left side of the dispenser 32 and paper roll core 12.

As aforesaid, by "frangibly fixed", it is meant that the link between the end wall 28 and the body 22 of the bushing 20 is capable of being easily broken; it is breakable. For example, in a case where the bushing is made of plastic, the frangible link is obtained by reducing the thickness of the plastic at the periphery of the end wall 28, as shown for example in FIG. 3 at junction 25 between the first end 24 and the side wall 28. The frangible link between the first end 24 of the body 22 and the side wall 28 can also be obtained by using a plastic that is sufficiently resistant to maintain the paper core 12 in alignment between the support members 34, 36, but brittle enough to break when someone tries to pull off the paper core 12 from the dispenser 32. Choosing the appropriate material will be well known to a person skilled in the art.

As best shown in FIG. 4*b*, the frangible link can also be obtained by providing the end wall 28 with discrete radial lines 29 of reduced thickness.

Figure 6:
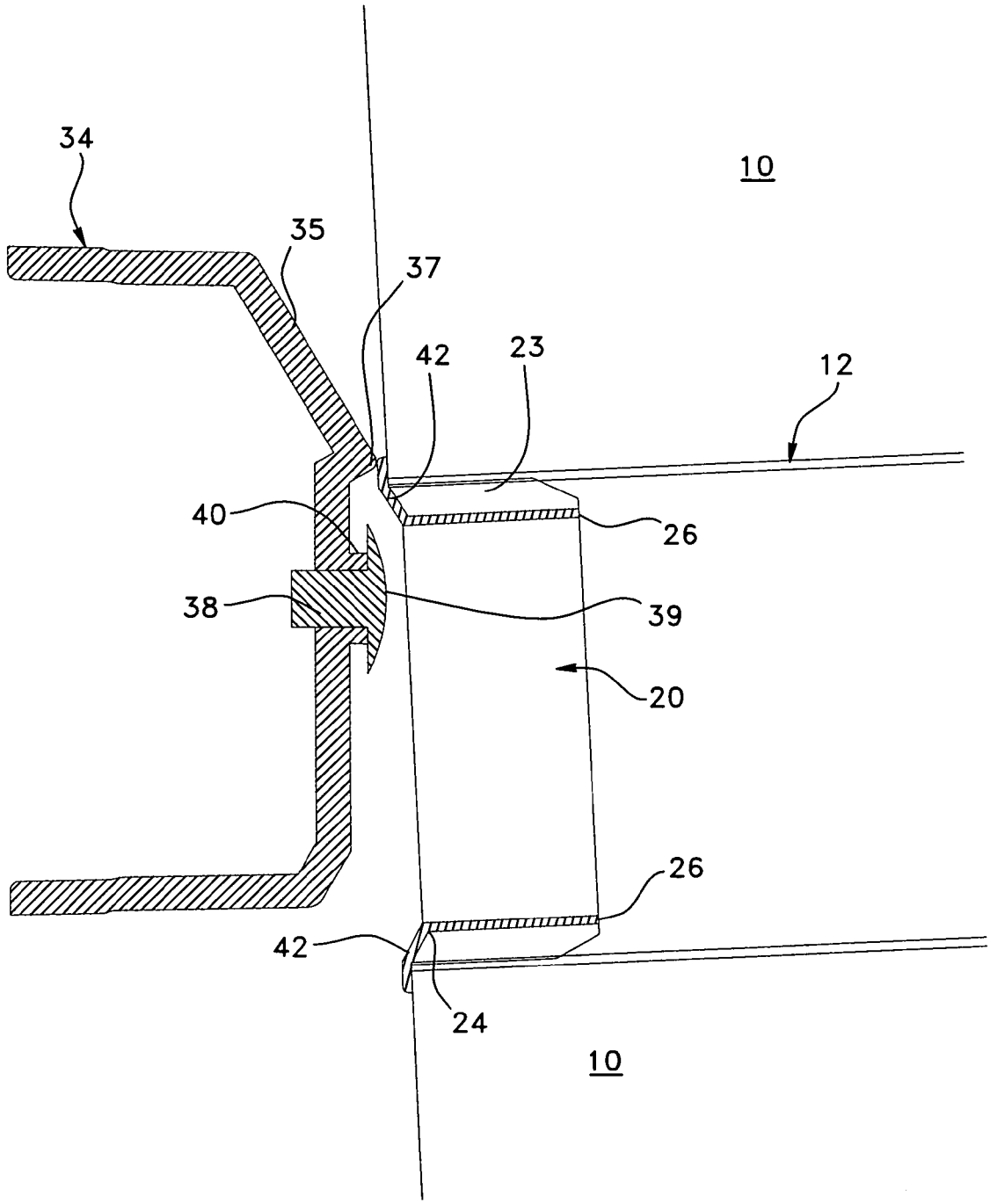
FIG. 6 is an enlarged view of a portion of the bushing and the dispenser supporting members shown in FIG. 5.
Figure 8:
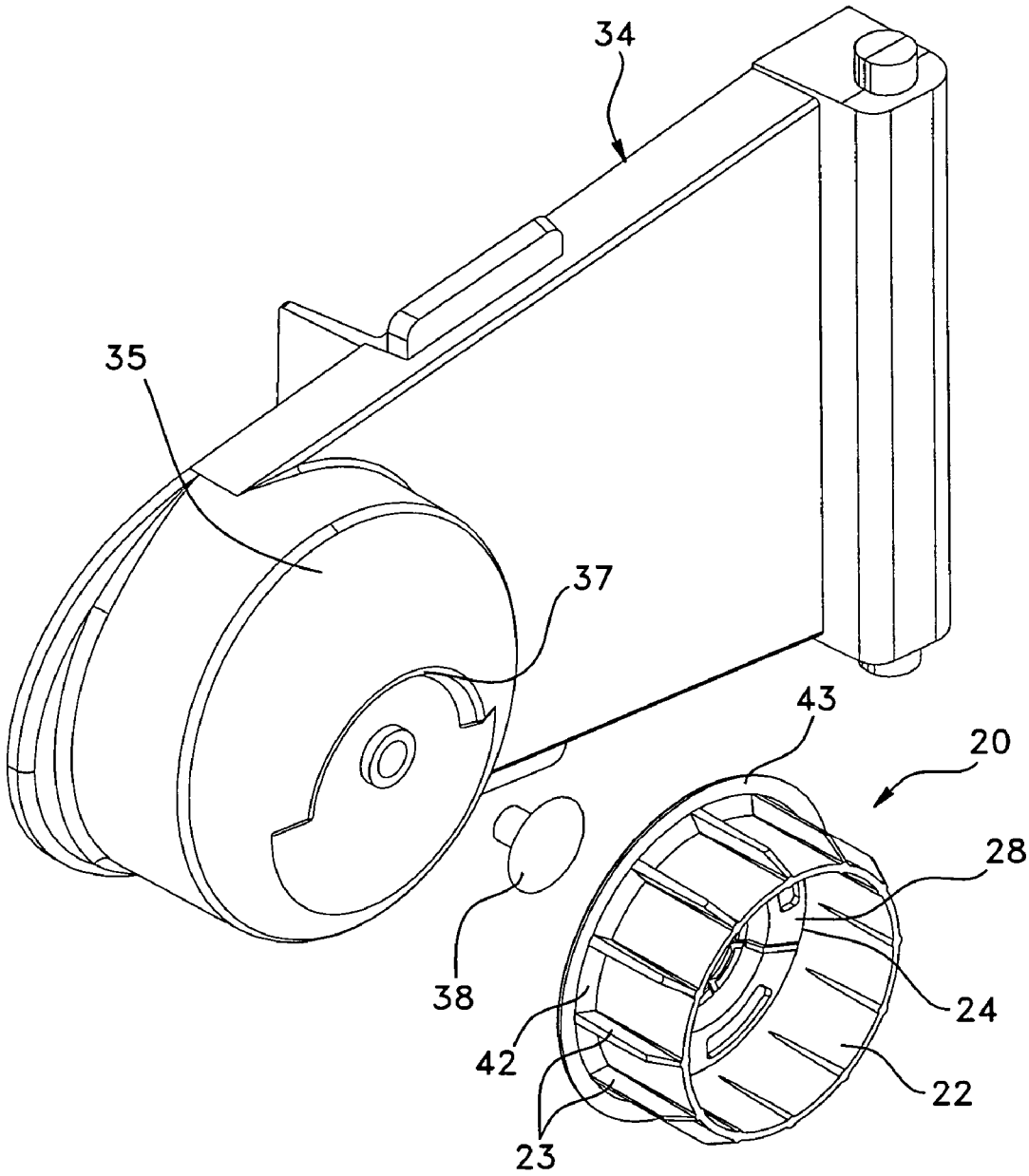
FIG. 8 is an exploded view of one of the dispenser supporting members with the bushing of FIG. 4.

Referring more particularly to FIGS. 3, 6 and 8, a projection 38 with a support flange 40 is protruding from at least one of the support members 34 of the dispenser. The paper roll core 12 is mounted between the supporting members 34, 36 of the dispenser by setting the end wall 28 provided with pin-receiving hole 30 on the support flange 40 of the projection 38. As best seen in FIG. 3, the support flange 40 supports the end wall 28 and maintains the paper roll 10 generally in alignment between the support members 34, 36. More preferably, the projection 38 is the head of a rivet having a body fixed into the support member 34 and the support flange 40 has a curved top part.

As best shown in FIGS. 1, 4*a* and 4*b*, the body 22 of the bushing 20 preferably comprises a plurality of ribs 23 extending longitudinally on the outside surface of the body 22, and engaging the interior surface of the paper roll core 12 to snugly fit the bushing 20 therein. Now turning to FIGS. 3, 6 and 9, the bushing 20 further preferably comprises a slanted collar 42 extending from and encircling the first end 24 of the body 22. The collar 42 projects exteriorly from the body 22 and forms an angle of more than 0° to less than 90°, preferably approximately 45° with a central axis "A" of the body 22. The ribs 23 described above originate from the collar 42 and structurally solidify the same. The bushing 20 further comprises a rim 43, as best shown in FIG. 3 or 4*a* and 4*b*, encircling the collar 42, and extending at right angle with the central axis "A" of the body 22. When the bushing is press-fitted in the roll core, the rim 43 abuts against the end of the core.

Figure 9:
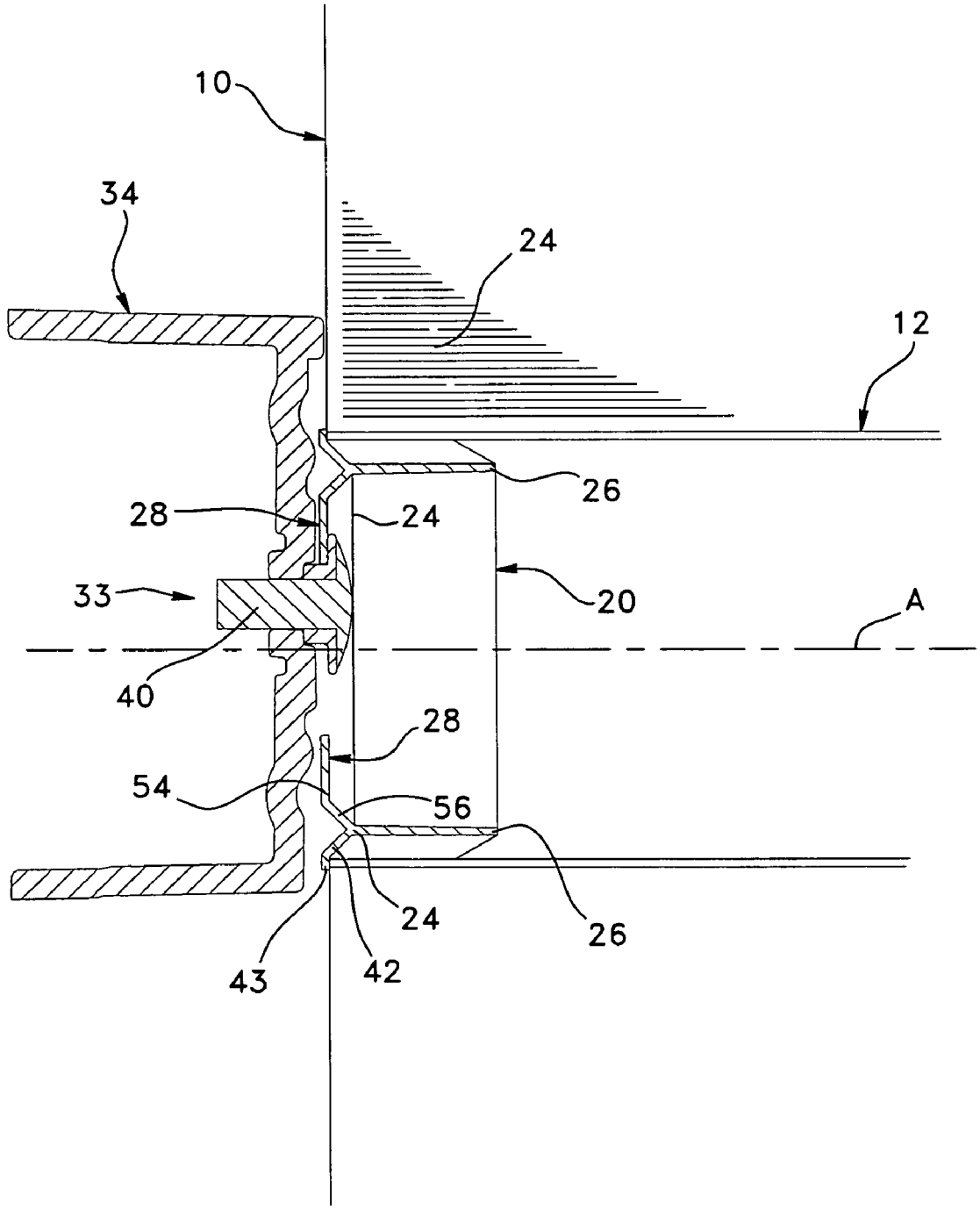
FIG. 9 is a view similar to FIG. 6 with a variant of the bushing and a variant of the dispenser supporting members.

Turning now to FIGS. 3, 4*a* and 9, it can be seen that the end wall 28 preferably has a centrally located exteriorly protruding part in which the pin-receiving hole 30 is located. The protruding part is preferably defined by a substantially planar wall portion 54 encircling the pin-receiving hole 30 and an angle portion 56 extending from the planar wall portion 54 towards the interior of the body. The angle portion 56 is either connected directly to the first end 24 of the body, as in FIG. 9, or via another planar wall section 58 which connects the angle portion 56 to the first end 24 of the body 22, as in FIGS. 4*a* and 3. Advantageously, the frangible link between the end wall 28 and the body 22 of the bushing can optionally be further obtained by reducing the thickness of the material at the junction 27 between the planar wall portion 54 and the angle portion 56 (see FIG. 3).

In the preferred embodiment of FIGS. 3, 6 and 8, the support member 34 adapted to receive the extremity 14 of the paper roll core 12 provided with the bushing 20 preferably has an overhang structure 35, resembling a nose, that projects over the projection 38. More preferably, that support member 34 has a configuration, including the overhang structure 35 and the projection 38, that mates the configuration of the end wall 28 such that the support member 34 can only receive a paper roll core 12 provided with a mating bushing 20. As seen in FIG. 3, the overhang structure 35 has a forward end 37 substantially flush with a forward end 39 of the projection 38. The forward end 37 of the support member 34 abuts on the planar wall portion 58 of the bushing 20 when a suitable paper roll core 12 is mounted into the dispenser. The distance spacing the forward end 37 of the overhang structure 35 from the projection 38 is sufficient to allow the planar wall portion 54 to enter therebetween. Thanks to these preferred configurations of the support member 34 and the end wall 28 of the bushing 20, a paper roll core 12 provided with such preferred end wall 28 can only pair up with that preferred support member 34.

Figure 5:
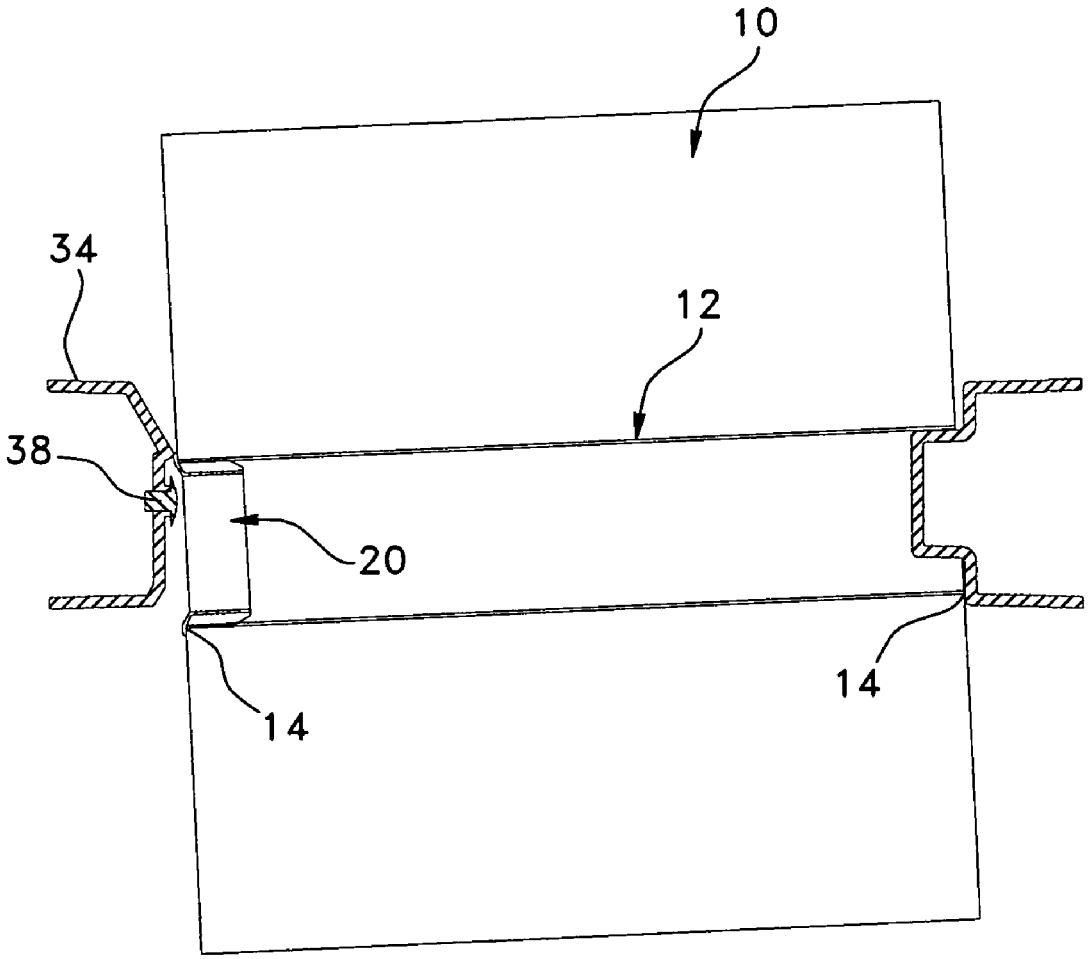
FIG. 5 is a cross-sectional side view of the dispenser and the paper roll shown in FIG. 1, after the inner locking ring is broken from the bushing.

As best shown in FIGS. 5 and 6, if the frangible end wall 28 is broken off, the support flange 40 can no longer maintain the paper roll 10 in correct alignment between the support members 34, 36. Indeed, the action of the slanted collar 42 with the overhang structure 35 of the support member 34 forces the paper roll core 12 to move away from the support member 34 and to free itself therefrom. The paper roll 10 nevertheless remains trapped between the support members 34, 36. In this misaligned configuration, it becomes impossible to dispense paper since the paper roll 10 falls between the supporting members 34, 36.

Figure 7:
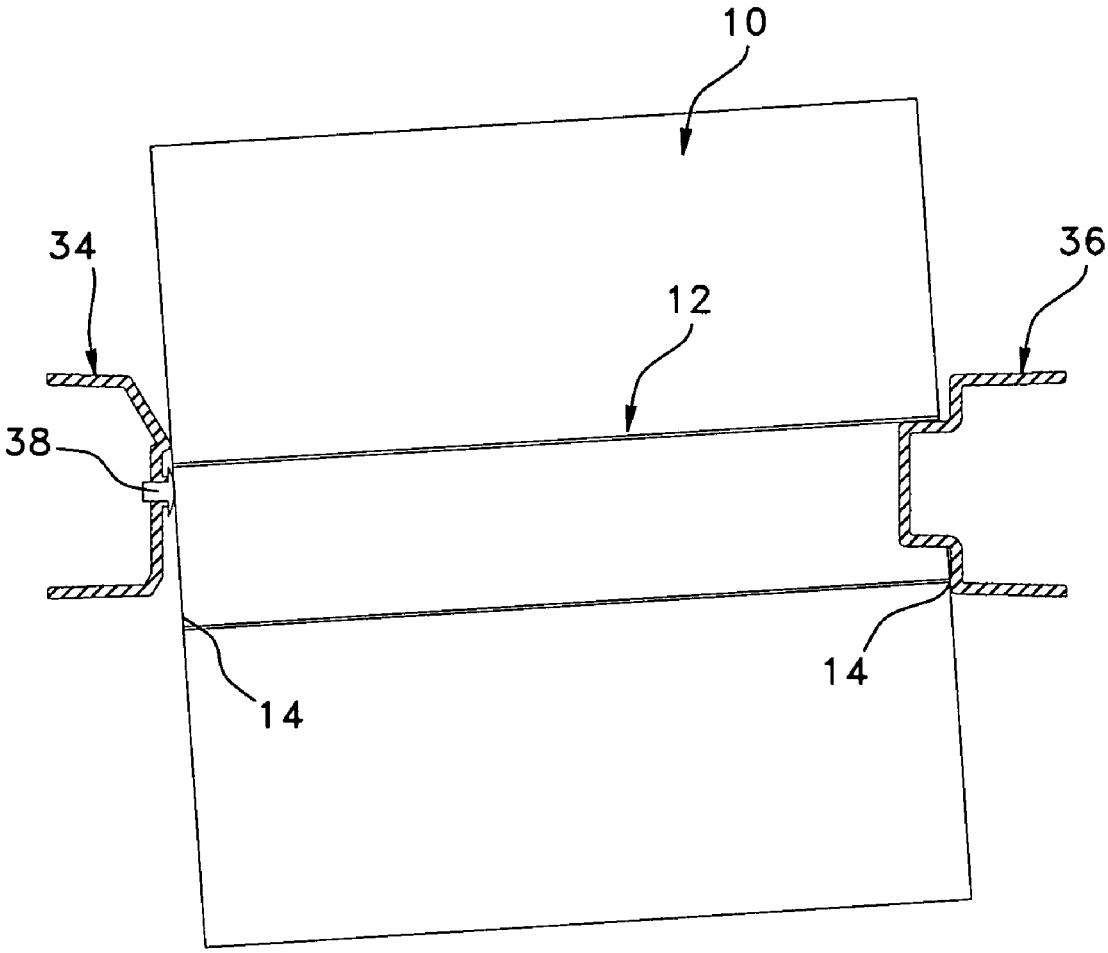
FIG. 7 is a cross-sectional side view of a dispenser compatible for use with a paper roll in accordance with the invention, showing a paper roll without the bushing placed in the paper roll core with the roll inserted in the dispenser.

Similarly, and as better shown in FIG. 7, if no bushing according to the present invention is inserted into the paper roll core 10, the support flange 40 can no longer maintain the paper roll 10 in correct alignment between the support members 34, 36. In this configuration, the overhang structure 35 forces the paper roll 10 to move away from the support member 34. Once again, the paper roll 10 remains trapped between the support members 34, 36 but it still impossible to dispense paper since the paper roll 10 simply falls between the support members 34, 36. As for the embodiment of FIG. 9, if no bushing according to the present invention is inserted into the paper roll core 12, the support flange 40 can no longer maintain the paper roll 10 in correct alignment between the support members 34, 36. In that case, the paper roll 10 remains trapped between the support members 34, 36 with the projection 38 entering into contact with the interior surface of the paper roll core 12. It however remains difficult to dispense the paper since the paper roll rubs against the support members 34, 36.

Although the present invention has been explained hereinabove by way of preferred embodiments thereof, it should be pointed out that any modifications to these preferred embodiments within the scope of the appended claims is not deemed to alter or change the nature and scope of the present invention.

As for example, both the pin-receiving hole 30 and the support flange 40 can have a wide variety of diameters and shapes, ranging from slender to bulky, depending on the embodiment of the present invention and the desired strength of the mating components.

The invention claimed is:

1. A paper roll comprising:

a hollow paper roll core with two opposite extremities;

a bushing having: a cylindrical body press-fitted into at least one of said extremities of the paper roll core; and a circular end wall frangibly fixed to a first end of said body and closing said extremity of the paper roll core, said end wall being provided with a central pin-receiving hole.

2. The paper roll according to claim 1, wherein the body of the bushing comprises:

an outside surface; an inside surface; and a plurality of ribs extending longitudinally on the outside surface of the bushing, and engaging an interior surface of the paper roll core to snugly fit the bushing therein.

3. The paper roll according to claim 2, wherein the bushing comprises a slanted collar extending from and encircling said first end of the body, said collar projecting exteriorly from the body of the bushing and forming an angle of more than 0.degree. to less than 90.degree. with a central axis of the body.

4. The paper roll according to claim 3, wherein said angle is 45.degree.

5. The paper roll according to claim 3, comprising a rim encircling the collar, and extending at right angle with the central axis of the body.

6. The paper roll according to claim 1, wherein the end wall and the body of the bushing are integral parts made of a same material, and the end wall is frangibly fixed to the first end of the body by means of a reduction in thickness of the material joining the end wall to the first end.

7. The paper roll according to claim 1, wherein the end wall has a centrally located exteriorly protruding part in which the pin-receiving hole is located.

8. The paper roll according to claim 7, wherein the protruding part of the end wall comprises a substantially planar wall portion encircling the pin-receiving hole and an angle portion extending interiorly from the planar wall portion.

9. The paper roll according to claim 8, wherein the angle portion is connected to the first end of the body.

10. The paper roll according to claim 9, wherein the end wall comprises another planar wall portion connecting the angle portion to the first end of the body.

11. A combination of a paper roll dispenser with a paper roll as defined in claim 1, the dispenser comprising:

support members for supporting the extremities of the paper roll core; and a projection protruding from at least one of the support members for engaging the pin-receiving hole of the bushing, said projection comprising a support flange for supporting the end wall and maintaining the paper roll generally in alignment between the support members.

12. A combination of a paper roll dispenser with a paper roll as defined in claim 10, the dispenser comprising:

support members for supporting the extremities of the paper roll core;

at least one of said support members having: a configuration mating a configuration of said end wall of the bushing; and a projection for engaging the pin-receiving hole of the bushing, said projection comprising a support flange for supporting the end wall and maintaining the paper roll generally in alignment between the support members.

13. The combination of claim 12, wherein said at least one support member comprises an overhang structure projecting over said projection and having a forward end abutting on said other planar wall portion when said paper roll is mounted in the dispenser.

14. A bushing for a paper roll core, comprising:

a cylindrical body sized to be press-fitted into an extremity of the paper roll core;

an end wall frangibly fixed to said body for closing said extremity of the paper roll core, said end wall being provided with a central pin-receiving hole.

15. A bushing according to claim 14, wherein the body comprises:

an outside surface;

an inside surface; and a plurality of ribs extending longitudinally on the outside surface of the bushing, for engaging an interior surface of the paper roll core to snugly fit the bushing therein.

16. The bushing according to claim 15, comprising a slanted collar extending from and encircling said first end of the body, said collar projecting exteriorly from the body of the bushing and forming an angle of more than 0.degree. to less than 90.degree. with a central axis of the body.

17. The bushing according to claim 16, wherein each of said ribs originates from said collar.

18. The bushing according to claim 14, wherein the end wall has a centrally located exteriorly protruding part in which the pin-receiving hole is located.

19. The bushing according to claim 18, wherein the protruding part of the end wall comprises a substantially planar wall portion encircling the pin-receiving hole and an angle portion extending interiorly from the planar wall portion.

20. The bushing according to claim 14, wherein the end wall and the body are integral parts made of a same material, and the end wall is frangibly fixed to the first end of the body by means of a reduction in thickness of the material joining the end wall to the first end.

* * * * *